United States Patent [19]

Wenneborg

[11] 4,007,966

[45] Feb. 15, 1977

[54] SINGLE-ENTRY MINING DEVELOPMENT SYSTEM

[75] Inventor: William Zorn Wenneborg, Thousand Oaks, Calif.

[73] Assignee: Atlantic Richfield Company, Los Angeles, Calif.

[22] Filed: Dec. 29, 1975

[21] Appl. No.: 644,585

[52] U.S. Cl. ..... 299/11; 61/45 C; 98/50; 299/12; 299/19

[51] Int. Cl.[2] ..... E21C 41/00

[58] Field of Search ..... 299/11, 12, 19; 98/50; 61/45

[56] References Cited

UNITED STATES PATENTS

| | | | |
|---|---|---|---|
| 1,131,852 | 3/1915 | Morgan | 299/12 X |
| 3,464,756 | 9/1969 | Burgess | 299/12 X |
| 3,590,590 | 7/1971 | Vujasinovic | 61/45 R |
| 3,715,969 | 2/1973 | Burgess | 299/12 X |

*Primary Examiner*—Ernest R. Purser
*Attorney, Agent, or Firm*—Robert M. Betz

[57] ABSTRACT

Spaced apart single entries are driven into a mineral deposit to be developed by means of a short wall mining machine. A specially designed concrete-receiving slip-form located in the center of the entry is pulled along by a battery of roof supports which are advanced in line behind the mining machine. Quick setting concrete pumped into the anchored slip-form sets up into a wall isolating the two sides of the entry. The slip-form is then released for each successive mining run.

9 Claims, 7 Drawing Figures

SINGLE-ENTRY MINING DEVELOPMENT SYSTEM

BACKGROUND OF THE INVENTION

1. Field of the Invention

This invention generally relates to the development of a mining layout within a mineral deposit and more particularly to a means and method for developing single entries which provides for roof support and division of air paths without the use of multiple entry sets.

2. Description of the Prior Art

Conventionally, a mineral deposit to be mined is divided into sections by driving groups of entries into the body of the deposit following a designated pattern. The number of such entries in each group is determined by the requirements imposed by a number of factors, to wit, ventilation, escape ways, haulage, drainage, water supply and power supply. Usually in a mineral deposit with thicker overburden, the number of entries in each group is reduced. Three entries in each group is usually the minimum. Among the typical disadvantages of such a conventional mining development are: (1) high roof pressure occurs in lower levels (e.g., multi-seam coal mining), (2) high cost and long period of time for mine development, (3) low extraction ratio, (4) extensive openings have to be inspected and maintained, (5) often requires complicated ventilation system, (6) extensive surface exposure causes dust problem (very serious in coal mines), (7) chain pillars create burst environment (rock or coal burst), and (8) continuous miner and roof bolting equipment system often exposes workers under improperly supported roof.

Chain pillars separating adjacent entries in a conventional development inevitably produce pressure buildup which is particularly harmful when successive layers are to be mined. Furthermore, the chain pillar construction forces a so-called "continuous" loader to operate intermittently. This is because it has to back up and develop the "breaks" between pillars, and stoppings have to be set up between each two of such pillars.

For the above reasons, single-entry mining of longwall underground mineral seams has been researched in this country. As an example, Kaiser Steel Corporation has been conducting a program of this type in operations at Sunnyside, Ut. This is reported in an article in the 1975 *Mining Yearbook* of the Colorado Mining Association beginning at page 101. The system described employs entries developed by a continuous miner and separated into two halves by fire retardant treated cribs installed not more than 4 feet apart along the entry's center line. Galvanized metal panels are attached to the cribs to form a curtain wall to establish intake and return entries, which are then sprayed to give an airtight seal and reduce the thermal gradients between sides. A travel curtain for a shuttle car and line brattice are used to ventilate the face from the end of the cribs and curtain wall. The cribs and curtain wall are said to be installed within 150 feet of the face at all times.

The advance rate of a single entry of the type described is necessarily limited by the speed and efficiency with which the entry dividing means can be erected. It is therefore with these problems that the present invention is most immediately concerned.

SUMMARY OF THE INVENTION

It is therefore a general object of this invention to provide an improved means and apparatus for driving development entries into a mineral deposit to be mined.

It is a further object of this invention to provide a method and apparatus for entry development which eliminates the necessity of leaving chain pillars.

It is a still further object of this invention to provide a means and method for driving a series of single entries into a mineral deposit to be mined instead of the conventional multi-entry sets.

It is a still further object of this invention to provide an improved means of entry development in the multi-level mining of a mineral deposit which eliminates pressure buildup between successive layers.

In accordance with the preferred embodiment of this invention, spaced apart single development entries are driven into a mineral deposit to be mined between parallel sets of main and submain entries. A short wall mining machine traverses the advancing face of each entry. Behind this machine a battery of roof chocks are advanced in line and roof bolts are installed. A specially designed concrete receiving slip-form aligned with the center of the entry is towed along by the advancing chocks. At the end of each mining shift, the slip-form is anchored and filled with quick setting concrete. The concrete sets into a wall extending to the mine roof which divides the entry along its center line, after which the slip-form is released for successive mining runs. A flexible curtain is positioned at all times between the top of the slip-form and the mine roof to provide air isolation between the two sides of the entry. An additional air curtain extends from the forward end of the slip-form to the forward end of the roof chocks to direct fresh air to the entire face area of the entry.

DESCRIPTION OF THE PREFERRED EMBODIMENTS

Figure 1:
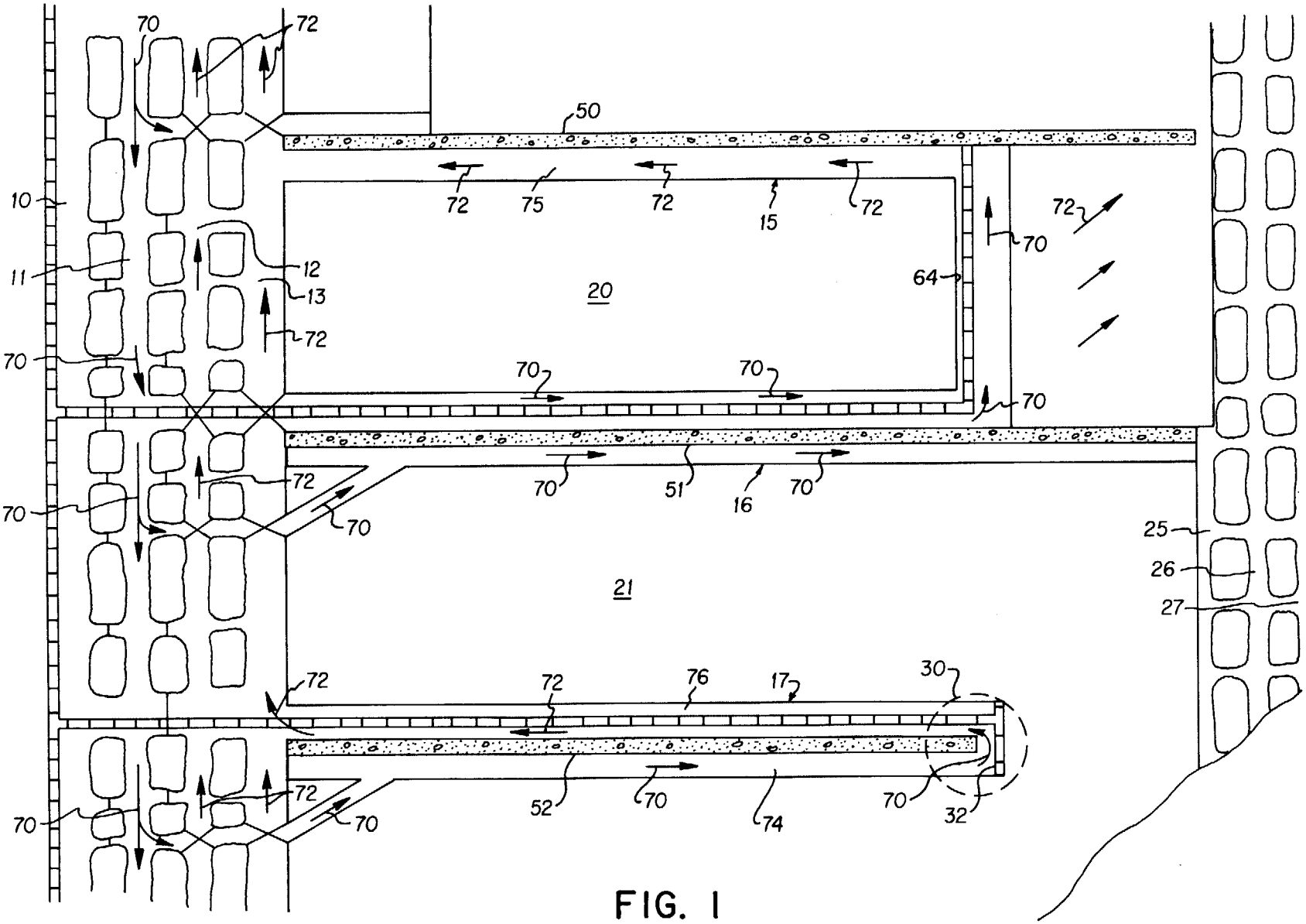
FIG. 1 is a diagrammatic layout of a longwall mining operation incorporating single-entries developed in accordance with this invention.

With reference now to FIG. 1, there is shown a mining layout adapted for exploiting an underground mineral seam by the longwall method. A series of submains such as submains 10, 11, 12 and 13 are driven into a mineral seam of interest in conventional fashion. From these submains, single-entries such as entries 15, 16 and 17 are driven at spaced apart intervals to establish longwall panels such as panels 20 and 21. A plurality of bleeder entries such as entries 25, 26 and 27 provide communication between entries 15 and 16 prior to the mining of the longwall panel 20 and at a later stage will be intersected by a single-entry 17.

Figure 2:
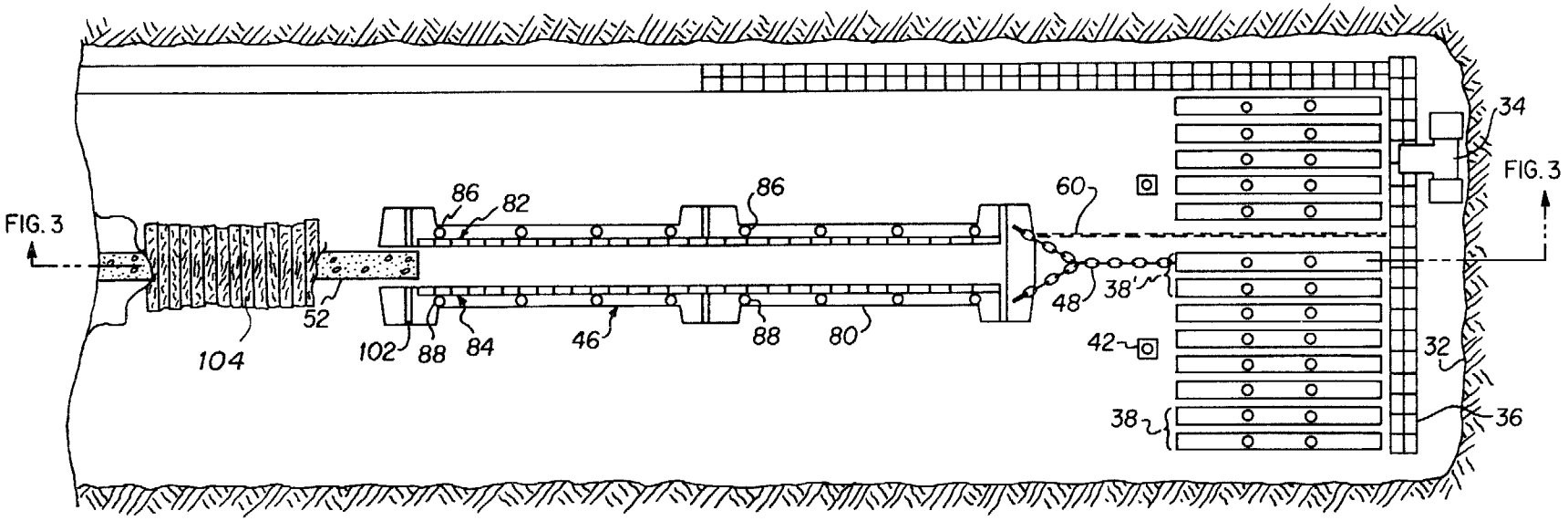
FIG. 2 is a plan view (party diagrammatic) of the advancing end of a single-entry containing equipment in accordance with this invention.
Figure 3:
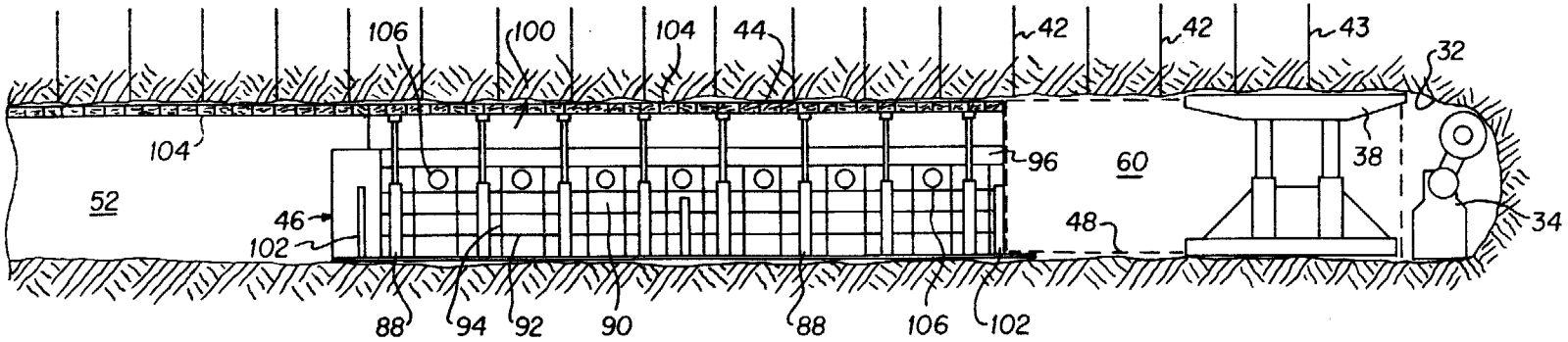
FIG. 3 is a sectional view taken along the line 3—3 in FIG. 2.

In order to understand the manner in which a single-entry such as entry 17 is developed in accordance with this invention, attention is now directed to FIGS. 2 and 3 which illustrate the advancing front end of the entry 17 generally within the area indicated by the dotted circle 30. The face 32 of the entry 17 is advanced by means of a stable driving machine 34 which loads conveyor 36 as it moves bidirectionally under the protection of a row of chock type, two-step roof supports 38. As each pass is made along the face 32, the mining machine 34 and conveyor 36 are advanced, followed by the two-step advance of the supports 38. Roof bolts 42 are inserted in mine roof 44 at suitable intervals behind the advancing supports 38. If desired, the roof-contacting frames or canopies of the supports 38 may be provided with apertures (not shown) to enable a roofbolter, from a position under the supports 38, to drill holes in the mine roof 43 adapted to receive bolts 42.

A concrete receiving slip-form 46 is towed behind the advancing row of roof supports 38 by means of a flexible chain 48 which may be connected to a centrally located roof support designated as 38'. The slip-form 46 is designed so that its concrete receiving length is equal to or greater than the expected advance of entry 17 in a single mine shift. In FIGS. 2 and 3, for example, the slip-form 46 is depicted as it appears at the end of a mine shift. In this position, the slip-form 46 has been lowered from the mine roof 44 and towed forwardly in increments beyond the end of the previously poured and set concrete wall 52 and again reset or anchored against the mine roof 44 for pouring additional concrete. At the beginning of the next mine shift, the slip-form 46 is again lowered to enable towing. In this manner, a continuous wall of concrete 52 is formed along the center line of the entry 17. In a manner which will be more particularly described in connection with FIGS. 4, 5, 6 and 7 the slip-form 46 is provided with means for providing air isolation between the two sides 56 and 58 of the entry 17 as the slip-form 46 is being advanced. For the same purpose an air curtain or line brattice 60 extends from the forward end of the slip-form 46 to the front edge of the row of roof supports 38.

Returning to FIG. 1, it can now be seen that in the manner generally described above continuous concrete walls 50, 51 and 52 are formed so as to divide entries 15, 16 and 17 along their respective center lines. As the mining of panel 20 progresses by retreating the face 64, the operation is suitably ventilated by bringing in fresh air from the submains 11 along both sides of the entry 16. The incoming fresh air path is indicated by directional arrows 70, the return air path being indicated by directional arrows 72 progressing along side 75 of the entry 15. As the entry 17 advances with continuous wall 52 being formed along its center line, fresh air is brought to the entry face 32 along the side 74 passing beyond the forward end of the wall 52 so as to return along the side 76 to the submain 13.

Figure 4:
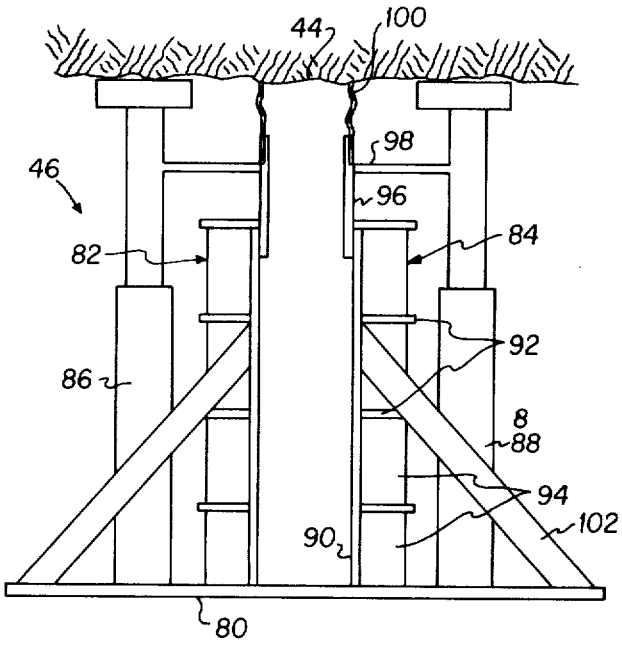
FIG. 4 is a rear elevation of a concrete receiving slip-form in accordance with this invention in a position raised for mining.

Turning now to FIG. 4, concrete receiving slip-form 46 consists generally of a base 80 upon which are erected spaced apart parallel upstanding steel frames 82 and 84, which may be anchored against the mine roof 44 by means of two parallel rows of hydraulic props such as props 86 and 88 extending upwardly from the base 80.

The frames 82 and 84 each comprise generally an upstanding plate 90 extending lengthwise of the entry 17 to be divided, and strengthened by the addition of a plurality of horizontal panels 92 and a plurality of vertical panels 94 oriented at right angles to the plane of the plate 90. Slidably secured to the inner surface of the plate 90 adjacent its upper edge is an extension plate 96 which is substantially coextensive with the plate 90. The extension plate 96 is adapted to be moved upwardly or downwardly by the hydraulic props 86 or 88, each of which is connected thereto by one of lifting bars 98. The upper edge of the extension plate 96 is in turn provided with a longitudinally extending section of flexible rubber belting, for example conveyor belting 100, adapted to contact the mine roof 44 or otherwise provide an air seal as will be described. In order to give the entire structure of slip-form 46 added stability, it is convenient to insert a plurality of pairs of slant braces 102 at spaced intervals between the base 80 and the upstanding plate 90 of each of frames 82 and 84.

Figure 5:
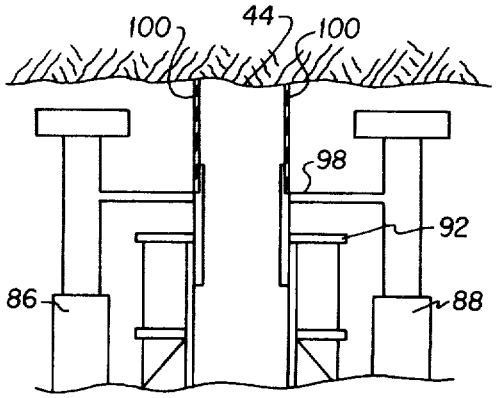
FIG. 5 is a detail of the view of FIG. 4 illustrating the concrete receiving slip-form in a lowered position.

In FIG. 4 the form 46 is shown with the props 86 and 88 anchored against the mine roof 44 and the extension plates 96 correspondingly raised to urge the flexible strips of belting 100 into contiguous relation with the uneven surface of the mine roof 44 to provide an air seal. In this position of the slip-form 46 the stable driving machine 34 is in operation to mine the face 32. After each pass of the mining machine 34, the props 86 and 88 are slightly depressurized as shown in FIG. 5 and the slip-form 46 is advanced a few feet. The extension plates 96 will be lowered but not sufficiently to break the contact between the mine roof 44 and the flexible belting 100. Throughout a mine shift the slip-form 46 is alternately anchored or lowered for advancement as described.

Figure 6:
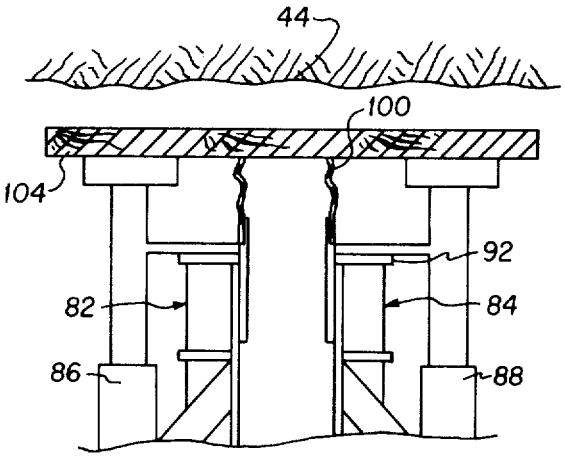
FIG. 6 is a detail of the view of FIG. 4 illustrating the concrete-receiving slip-form lowered with stress-relief frames in place.
Figure 7:
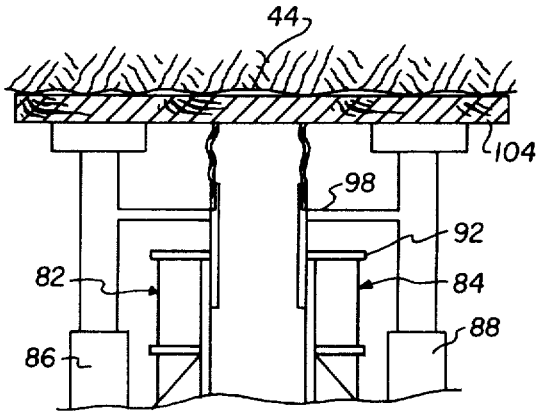
FIG. 7 is a further detail of the view of FIG. 4 illustrating the concrete receiving slip-form anchored for a pouring operation.

At the end of the shift described, the props 86 and 88 are lowered still further as shown in FIG. 6 and a plurality of wooden frames 104 are laid across the top of the slip-form 46 along its entire length so as to extend beyond its full width. The props 86 and 88 are then repressurized as in FIG. 7 so as to urge the frames 104 against the mine roof 44 and to anchor the slip-form 46 in place. The purpose of the wooden frames is to provide high stress relief for the wall 52 after it sets up—since the concrete might otherwise buckle. In the positions of FIG. 6 and FIG. 7, the rubber belting 100 remains compressed so as to complete the necessary air seal against the under surfaces of the wooden frames 104. The next shift then pumps a quick drying cement into the slip-form 46 under pressure through the holes 106 (FIG. 3). Conventional concrete mixing and pumping equipment may be brought into the single entry 17 and if desired can be suitably affixed to the row of mine supports 38 for towing. After the concrete sets to form wall 52, the slip-from 46 is again released for the next mining run.

While a preferred embodiment of this invention has been described, it will be understood that various changes and modifications can be introduced in the overall mining plan and in the equipment employed without departing from the spirit and scope of such invention as set forth in the claims appended hereto.

The embodiments of the invention in which an exclusive property or privilege is claimed are defined as follows.

1. A method of developing a single-entry for use in longwall mining comprising the steps of:

a. advancing the working face of the entry;

b. dividing said entry lengthwise by means of a continuous upstanding wall formed in progressive increments in following spaced relation to said face as it is advanced, said wall being adapted to provide load bearing support and air isolation between the two sides thereof; and c. directing air flow from the leading edge of said wall to said face during the mining of said entry.

2. A method as in claim 1 wherein high stress relief means are provided which separate the top of said wall and the roof of said entry.

3. A method as in claim 2 wherein said high stress relief means consist of a plurality of adjacent wooden frames resting on the top of said wall.

4. A method as in claim 1 wherein said wall is formed of quick setting concrete.

5. A method as in claim 4 including the repetitive steps of pumping said concrete into an anchored slip-form, allowing said concrete to set, lowering and advancing said slip-form toward said working face, and reanchoring said slip-form.

6. A method as in claim 5 including the step of towing said slip-form by means of roof supports advanced with said working face.

7. A method as in claim 6 including the step of providing an air curtain between the leading edge of said slip-form and the face side of said roof supports.

8. A method as in claim 5 including the step of providing an air seal between the top of said slip-form and the roof of said entry.

9. A method as in claim 8 wherein said air seal means is at least one strip of flexible rubber belting substantially coextensive with the concrete receiving length of said slip-form and affixed thereto.

* * * * *